United States Patent [19]

Wöste

[11] Patent Number: 4,567,064

[45] Date of Patent: Jan. 28, 1986

[54] METHOD AND APPARATUS FOR THE MARKING OF GAS-PERMEABLE FABRIC OF CLOTH WEBS AND OTHER MATERIAL WEBS, ESPECIALLY FOR THE AUTOMATIC MARKING IN A MARKING STATION

[75] Inventor: Josef Wöste, Greven, Fed. Rep. of Germany

[73] Assignee: Anton Cramer GmbH & Co. KG, Greven, Fed. Rep. of Germany

[21] Appl. No.: 581,089

[22] Filed: Feb. 17, 1984

[30] Foreign Application Priority Data

Feb. 21, 1983 [DE] Fed. Rep. of Germany ..... 3305907

[51] Int. Cl.[4] ..... B05D 1/32; B05D 3/00

[52] U.S. Cl. ..... 427/157; 427/282; 427/288; 427/293; 427/296; 118/50; 118/301; 118/315; 118/325; 118/326; 118/40; 68/205 R

[58] Field of Search ..... 427/293, 294, 157, 243, 427/282, 288, 296; 68/5 C, 200, 205 R; 118/50, 301, 315, 326, 40, 325; 8/149.1, 445

[56] References Cited

U.S. PATENT DOCUMENTS 3,991,706 11/1976 Pearl ..... 118/696 X 4,141,231 2/1979 Kudlich ..... 118/697 X 4,173,928 11/1979 Mitter ..... 68/200 X

*Primary Examiner*—Norman Morgenstern

*Assistant Examiner*—Ken Jaconetty

*Attorney, Agent, or Firm*—Felfe & Lynch

[57] ABSTRACT

For the marking of gas-permeable fabric or cloth webs and other material webs, especially for the automatic marking in a marking station, the invention proposes to contact the fabric web within the marking station with a film including the pattern to be marked off in the form of perforations and acting as a stencil, and to suck atomized paint (paint mist) through the perforations and the contacting fabric web, wherein this atomized paint is an aerosol produced by atomization of a liquid containing a dye or pigment dissolved therein. Advantageously, a fluorescent dye is used to this end. A corresponding apparatus comprises, below the fabric web, an atomizing chamber equipped with nozzles for producing the atomized paint, with the film being positioned on the gas-permeable upper side thereof, as well as, above the fabric web, a vacuum compartment having a gas-permeable lower side in the form of a grate, and a resilient, gas-permeable (pressure) cushion attached to the grate and acting to hold down the fabric web on the film, and, further, means for generating a vacuum, and a control unit controlling the cooperation of the functions.

13 Claims, 2 Drawing Figures

Figure 1:
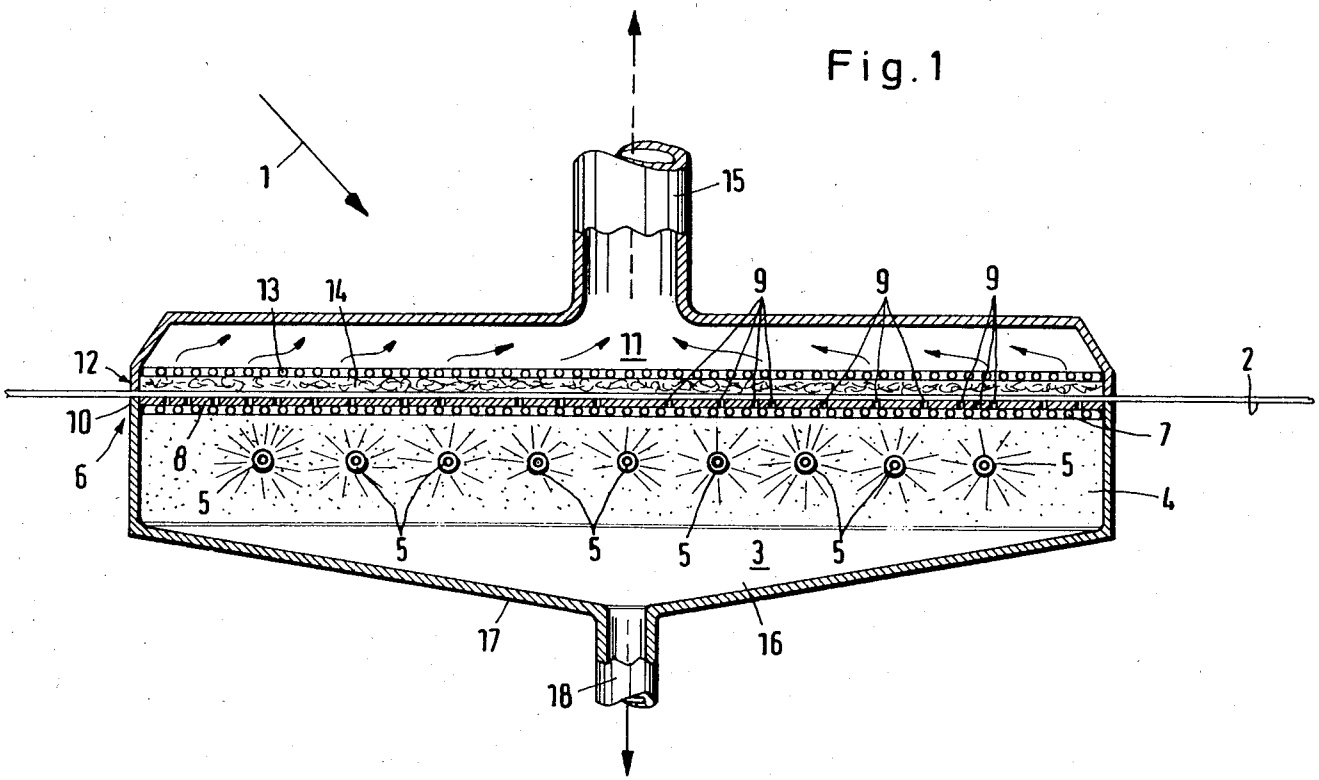

METHOD AND APPARATUS FOR THE MARKING OF GAS-PERMEABLE FABRIC OF CLOTH WEBS AND OTHER MATERIAL WEBS, ESPECIALLY FOR THE AUTOMATIC MARKING IN A MARKING STATION

The present invention relates to a method and an apparatus for the marking of gas-permeable fabric or cloth webs and other material webs, especially for the automatic marking in a marking station.

Individually processed fabric (or cloth) webs, such as ticks for the manufacture of wadded bed quilts, are normally marked by a manual procedure. This procedure involves difficulty with respect to drawing the marking points or lines, on the one hand, so clearly that they are discernible in the sewing process; on the other hand, the markings must not be optically apparent in the final wadded article. The latter applies particularly for the reason that it is, of course, not possible to wash or clean a wadded quilt after the sewing process. Presently, such fabric webs—as mentioned—are marked manually as lightly as possible by leadpencil. In the subsequent sewing process it is highly trying for the eyes of the operator to recognize the markings. Previous efforts to overcome this dilemma failed to furnish usefuly results so far.

It is the object of the present invention to provide a method and an apparatus for the marking of fabric (or cloth) and other material webs, especially for the automatic marking, which, on the one hand, ensure a sufficiently clear marking for the sewing process, and which, on the other hand, do not leave any markings discernible by the naked eye in the finished sewn article.

Suprisingly and according to the invention, the solution of this object is achieved in that the fabric web is contacted within the marking station with a film, as a stencil, including the pattern to be marked off in the form of perforations, and that an atomized paint (paint mist or spray) is sucked through the perforations in the film and through the contacting fabric web.

The method according to the invention provides the advantage that the paint mist or atomized paint, as far as its optical effect is concerned, produces very sensitively shaded paint mark in the fabric. As the paint spray is sucked through the fabric only in the positions of the perforations formed in the film used as a stencil, the marking raster may be defined by a number of paint or color spots disposed in any desired positions, and with optional spacings, which spots are readily discernible in the sewing process on the one hand, but are no longer visible in the region of the finished seam.

In further development of the method, the atomized paint comprises an aerosol produced by atomization of a liquid containing a dye or pigment dissolved therein.

Advantageously, this results in a colloidal system in which air constitutes the dispersant in which the liquid particles, containing a dye or pigment in solution, are dispersed in a range of particle size of between 0.5 micron and 2 microns and in the form of suspended particles.

As another advantage, optimum homogeneity of the atomized paint is thereby obtained, whereby an extremely uniform marking effect is produced.

According to a preferred embodiment, it is further contemplated that a fluorescent dye is used as said dye or pigment, and water is employed as said dissolving liquid.

In addition to the above-discussed principal advantages of the method according to the invention, the use of a fluorescent dye provides the further substantial advantage that markings produced by a fluorescent dye may be caused to light by irradiation with a light source emitting ultraviolet radiation, such that the markings are clearly visible in the sewing operation, whereas these markings are not visible under normal daylight or artificial light.

In order to obtain optimum atomization of the dye dissolved in the liquid, it is further contemplated that atomization is effected by means of high pressure with the aid of an atomizing nozzle or by means of compressed air and/or propellant gas with the aid of pneumatic atomizing nozzles.

Both alternatives are expedient and beneficial to the method according to the invention, as they make use of customary and approved systems and methods. For example, suitable functional elements adapted from the field of fuel atomization in diesel engines are available for the atomization by means of high pressure with the aid of atomizing nozzles. For the atomization by means of compressed or propellant gas with the aid of spray nozzles, such functional elements and technologies may be utilized as are used in the spray cans commercially sold by millions, which spray cans permit spraying substantially every liquid by means of a propellant at a pressure of about 3 to 4 bar (atmospheres) at room temperature, thereby to produce an entirely homogeneous aerosol spray.

Another preferred feature of the invention resides in the fact that the fabric web is placed onto the film, and that the atomized paint is sucked through the film and the fabric web from above.

In this way, it is avoided in advantageous manner that, due to condensation in the course of repeated marking cycles, condensed droplets might pass through the perforations of the stencil or film in uncontrolled fashion, to thereby smear the marking pattern.

For continuously carrying out the method, an expedient embodiment of the invention is characterized in that the fabric web is periodically or cyclically drawn into the marking station, placed onto the film, covered by a gas-permeable, elastic material layer, and pressed onto the film, whereupon a spray of atomized paint is injected into a space below the film and, simultaneously, a vacuum is generated within a space above the material layer, whereby the cooperation of these measures, adapted to be limited in time, is effective to suck a given amount of atomized paint through the film and the fabric web, whereupon the vacuum is caused to be reduced and the marked fabric web is removed from the marking station.

As a variant of corresponding method parameters, in this connection it is contemplated that the vacuum, after a given period of time, is set to a vacuum of between 100 and 1000 mm of water column, preferably to about 300 of water column, and reduced immediately thereafter.

It is particularly this measure, being preferred for the invention, that allows to obtain the advantage that the intensity (density) of the marking pattern is in exact correspondence with a predetermined value.

In a further expedient embodiment, it is contemplated that the timed application of the spray of atomized paint is initiated in response to a given vacuum, and the duration in time thereof is limited by a given cut-off pulse.

An apparatus for the marking of gas permeable fabric webs and other material webs according to the method of the present invention comprises a marking station which comprises a system for guiding the fabric web, including means for inserting the fabric web in the marking apparatus and for severing marked fabric web sections, as well as, below the fabric web, an atomizing chamber provided with nozzles to produce atomized paint and including a film as a stencil positioned on the gas-permeable upper side thereof, and further, above the fabric web, a vacuum compartment having a gas-permeable lower side in the form of a grate, and a gas-permeable material layer positioned as a resilient (pressure) cushion on the grate; and further comprising means for generating a vacuum as well as a frame provided with means for lifting and lowering at least the vacuum compartment.

Figure 2:
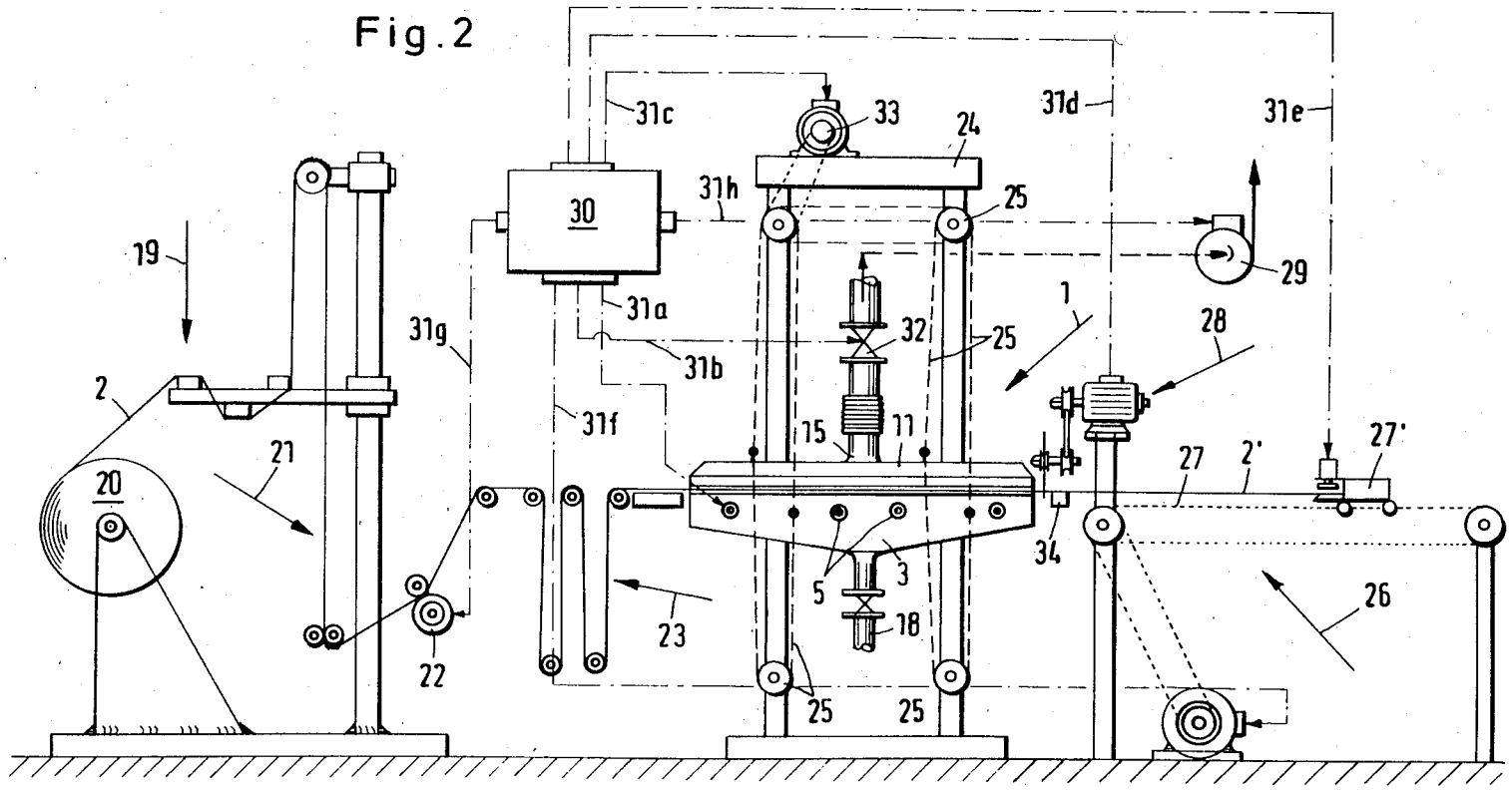

In the following, the invention and its advantages are explained in greater detail by referring to an exemplary embodiment illustrated in the drawings, wherein:

FIG. 1 is a sectional view of an apparatus for the marking of fabric (or cloth) webs; and FIG. 2 is a schematical side elevational view of a fully automatic marking station including a marking apparatus according to FIG. 1.

Referring now more particularly to FIG. 1 of the drawings, the marking apparatus 1 includes, below the fabric (or cloth) web 2, an atomizing chamber 3 having mounted to the side wall 4 thereof nozzles 5 for producing the paint spray or atomized paint. The upper side 6 facing the fabric web 2 is formed as a gas-permeable surface in the form of a grid or grate 7. A film 8 is placed onto this grid or grate 7. The film is provided with perforations so as to act as a marking stencil. For example, the perforations may constitute a marking pattern in the form of parallel and perpendiculary crossing or intersecting lines the extension of which is made distinct by separate, spaced marking spots. Such marking spots may be formed, for example, by punching or drilling in the film, and they may have a diameter of e.g. 0.75 mm. The film proper may be formed from metal (foil), hard paper, plastics material or the like; expediently, the film is of small thickness, such as of from 0.5 to 1 mm. The film 8 rests on the grate 7 without using special mounting means, and it is retained in its position by the upper edges 10 of the atomizing chamber 3 overlapping the plane of the grate 7 by the thickness dimension of the film 8. Thin films 8 are greater (in area) than the area of the atomizing chamber 3, and to fix such films, they are stretched at their projecting and possibly depending edges (not shown).

The fabric web 2 is positioned immediately above the film 8. Above the web, the vacuum compartment 11 is provided, the lower side 12 of which, facing the fabric web 2, is likewise open to be permeable to gas and formed as a grid or grate 13. Interposed between this grid or grate 13 and the fabric web 2 is a (pressure) cushion 14 made of a resilient, gas-permeable material. This material may be a highly porous plastic foam or a resilient cushion (pad) of Dralon felt or of a soft fleece (non-woven material) made of plastic fibers. The vacuum compartment 11 includes a connector pipe 15 by which it is connected to a not illustrated vacuum generating system. The nozzles 5 of the atomizing chamber 3 are in turn connected to a system for supplying a liquid containing a dye or pigment dissolved therein. However, this supply system is not shown in the drawing, because such a system is well-known to the one skilled in the art on the one hand, and does not form part of the invention on the other hand. As indicated above, the nozzles may be high-pressure atomizing nozzles, similar to the fuel (atomizing) nozzles of a Diesel engine. Alternatively, pneumatic atomizing nozzles may be used which are operated, for example, by compressed air. The choice of such nozzles for producing the atomized paint to be employed according to the invention is a matter of the expert's technical ability. In order to collect and recycle not consumed excess portions of the atomized paint which tend to condensate, the lower portion 16 of the atomizing chamber 3 is provided with a slightly inclined bottom 17 and a drain or exhaust pipe 18. Alternatively, the material may be sucked off from the sump of the bottom 17 directly by the nozzles through feed lines extending to the nozzles.

The operation of the apparatus is as follows: For placing or inserting the fabric web 2 in the marking apparatus, the latter is opened first. In this state, the vacuum compartment 11 is raised relative to the atomizing chamber 3; if necessary, the atomizing chamber 3 is lowered at the same time. When the fabric web is placed in position, the marking apparatus 1 is closed by abutting the vacuum compartment 11 and the atomizing chamber 3 against the fabric web 2 and against each other. Then, by opening a valve or starting a suction pump, air is evacuated from the vacuum compartment 11 via the connector pipe 15, and a vacuum of the order of about 300 mm of water column is produced. Shortly after the start of the evacuation while the vacuum produced within the vacuum compartment 11 is still increasing, a spray of atomized paint is produced by the nozzles 5 for a short time, which spray is almost uniformly distributed through the atomizing chamber 3. By means of the vacuum produced within the vacuum chamber 3, atomized paint is then sucked through the perforations 9 formed in the film 8 and through the fabric web 2, thereby producing colored marking spots in the fabric web. Immediately thereafter, the vacuum is caused to diminish, the marking apparatus 1 is opened, and the finally marked fabric web 2' is removed from the apparatus or replaced by a new fabric web for the next marking cycle, respectively.

FIG. 2 illustrates a fully automatically operating marking station which operates cyclically in accordance with the principle of function described above. This station comprises an unwinding (unreeling) device 19 including a supply of an endless fabric web 2 in the form of a reel 20. From the latter, the fabric web 2 is fed to the marking apparatus 1 through web guide means 21 by driven take-off rollers 22 through a compensator 23. The apparatus 1 is positioned in a frame 24 in which the atomizing chamber 3 and the vacuum compartment 11 are adapted to be lifted and lowered, respectively, by means of a schematically shown lifter 25, and opened and closed relative to each other. Further, the marking station includes a system 26 for guiding the fabric web 2 and having means 27 for transporting or conveying the fabric web 2. Furthermore, a severing device 28 is provided which severes the finally marked fabric web 2' drawn out from the marking apparatus 1 by the conveyor means 27. Vacuum producing means 29 are shown only schematically in the form of an exhaustor. Finally, the fully automatic marking station includes a central control unit 30 having control lines **31*a* to 31*h*** which extend to the various components a functional unity.

An operation cycle which is repeated in identical form in the next period of operation, is performed as follows: Upon drawing out a marked fabric web 2' with the chamber 3 and the compartment 11 opened, the severing device 28 is operated to sever the fabric web 2'. Then, the conveyor carriage 27', is returned to the marking station 1 to grasp the severed end of the fabric web 2' and pull the latter through the opened marking apparatus 1 by the length of a marking section. The marking station is thereafter re-closed by abutting the vacuum compartment 11 and the atomizing chamber 3 against each other with the fabric web 2 interposed. Following this, the control unit 30 provides a command for the production of the vacuum by starting operation of the exhaustor 29 and opening the shut-off member 32. A short period later, the control unit 30 furnishes the command to produce atomized paint by activation of the atomizing devices or nozzles 5 provided for this purpose, as schematically indicated by the control line 31*a*. Shortly after the atomized paint has been sucked through the perforations of the stencil or film 3 and through the fabric web 2, the control unit 30 commands the reduction of the vacuum and the opening of the marking apparatus 1, namely by lifting up the vacuum compartment and lowering the atomizing chamber. This command (signal) is supplied to the motor 33 of the lifter 25 via control line 31*c*. Then, the severing device 28 is activated by a corresponding command transmitted via control line 31 *d*, to severe the fabric web. In this operation the fabric web is held by a vacuum bar 34, and, optionally, a not illustrated hold-down element. The sequence of cycles is repeated correspondingly, whereby the conveyor means 27 pull out a length of the fabric web 2 in each cycle, and the thus newly inserted length of the fabric web is marked.

I claim:

1. A method for the marking of a gas-permeable fabric or cloth webs or other material webs for a marking station comprising:

guiding the fabric web including inserting the fabric web in marking apparatus and severing marked fabric sections;

contacting the web with a film as a stencil positioned on the gas-permeable lower side of the fabric and including the pattern to be marked off in the form of perforations;

sucking an atomized paint through the perforations in the film from below to above the fabric web and through the contacting fabric web by a vacuum compartment having a gas-permeable lower side comprising a grate;

interposing between the grate and the fabric web a resilient gas-permeable material layer as a cushion;

abutting the vacuum compartment and the atomizing chamber against each other with the fabric web interposed therebetween and pressed down by the grate and cushion.

2. The method according to claim 1 in which the atomized paint comprises an aerosol produced by atomization of a liquid containing a dye or pigment dissolved therein.

3. The method according to claim 1 in which a fluorescent dye is used as said dye or pigment, and water is employed as said dissolving liquid.

4. The method according to claim 1 in which atomization is effected by means of high pressure with the aid of an atomizing nozzle.

5. The method according to claim 1 in which the fabric web is placed onto the film, and the atomized paint is sucked through the film and the fabric web from below to above.

6. The method according to claim 1, in which, when the method is carried out continuously, the fabric web is periodically or cyclically drawn into the marking station, placed onto the film, covered by a gas-permeable, elastic material layer, and pressed onto the film, whereupon a spray of atomized paint is injected into a space below the film and, simultaneously, a vacuum is generated within a space above the material layer, whereby the cooperation of these measures, adapted to be limited in time, is effective to suck a given amount of atomized paint through the film and the fabric web, whereupon the vacuum is caused to be reduced and the marked fabric web is removed from the marking station.

7. The method according to claim 1 in which the vacuum, after a given period of time, is set to a vacuum of between 100 and 1000 mm of water column and reduced immediately thereafter.

8. The method according to claim 1 in which the timed application of the spray of atomized paint is initiated in response to a given vacuum, and the duration in time thereof is limited by a given cut-off pulse.

9. An apparatus for the marking of gas-permeable fabric or cloth webs and other material webs, especially for automatic marking in a marking station, according to the method of claim 1 in which the marking station comprises a system for guiding the fabric web, including means for inserting the fabric web in the marking apparatus and for severing marked fabric web sections, as well as, below the fabric web, an atomizing chamber provided with nozzles to produce atomized paint and including a film as a stencil positioned on the gas-permeable lower side of the marking station, and further, above the fabric web, a vacuum compartment having a gas-permeable lower side comprising a grate, and a gas-permeable material layer positioned as a resilient cushion under the grate; and further comprising means for generating a vacuum as well as a frame provided with means for lifting and lowering at least the vacuum compartment, for pressing down on the fabric web, and optionally the atomizing chamber.

10. The apparatus according to claim 9, in which the atomizing chamber and the vacuum compartment are each a relatively flat three-dimensional structure having a rectangular cross-section being congruent in the plane of the fabric web, the dimensions of which are equal to at least those of the fabric web; and in which the upper side of said chamber and the lower side of said compartment, respectively, each comprise a gas-permeable grate.

11. The apparatus according to claim 9 in which the atomizing chamber is provided on the side walls thereof with spaced atomizing nozzles.

12. The apparatus according to claim 9 in which the vacuum compartment is connected to a vacuum space or a vacuum blower through at least one connector pipe and a conduit having a shut-off member connected thereinto.

13. The apparatus according to claim 9 in which the vacuum compartment is equipped with an accordion-like bellows operable by lifting means, to generate an internal pressure which increases and decreases in response to volume variations of the compartment.

* * * * *